US006616308B2

(12) United States Patent
Jensen et al.

(10) Patent No.: US 6,616,308 B2
(45) Date of Patent: Sep. 9, 2003

(54) IMITATION CANDLE

(75) Inventors: Bradford B. Jensen, Saint Joseph, MI (US); Roger D. Bentley, Coloma, MI (US); Kim I. McCavit, Saint Joseph, MI (US)

(73) Assignee: Jenesis International, Inc., Stevensville, MI (US)

( * ) Notice: Subject to any disclaimer, the term of this patent is extended or adjusted under 35 U.S.C. 154(b) by 0 days.

(21) Appl. No.: 09/929,843

(22) Filed: Aug. 14, 2001

(65) Prior Publication Data

US 2003/0035291 A1 Feb. 20, 2003

(51) Int. Cl.[7] ..... F21V 11/00
(52) U.S. Cl. ..... 362/351; 362/392; 362/190
(58) Field of Search ..... 362/351, 392, 362/810, 800, 190

(56) References Cited

U.S. PATENT DOCUMENTS

| | | | | |
|---|---|---|---|---|
| 2,164,378 A | | 7/1939 | Berwick | |
| 3,749,904 A | | 7/1973 | Graff | |
| 3,873,880 A | | 3/1975 | Riddell | |
| 3,890,085 A | * | 6/1975 | Andeweg | 362/161 |
| 4,159,442 A | * | 6/1979 | Komatsu | 315/156 |
| 4,866,580 A | * | 9/1989 | Blackerby | 362/191 |
| 5,097,180 A | * | 3/1992 | Ignon et al. | 362/161 |
| 5,152,602 A | * | 10/1992 | Boschetto | 362/276 |
| 5,863,108 A | * | 1/1999 | Lederer | 362/186 |
| 5,879,076 A | | 3/1999 | Cross | |
| 5,980,064 A | * | 11/1999 | Metroyanis | 362/157 |
| 6,017,139 A | | 1/2000 | Lederer | |
| 6,053,622 A | * | 4/2000 | Horowitz et al. | 362/276 |
| 6,309,092 B1 | * | 10/2001 | Bardeen et al. | 362/202 |

FOREIGN PATENT DOCUMENTS

DE 197 34 345 2/1999

OTHER PUBLICATIONS

Norex Enterprises, Inc., Electronic Candles and Chargers, pubished on the Internet @ http://www.norex–enterprises.com/candle.htm.

EternaLight, Inc., Eternalights, 1999; http://www.eternalight.com/faq.htm.

Texas Instruments; SN54HC14, SN74HC14 Hex Schmitt–Trigger Inverters, 1997.

* cited by examiner

*Primary Examiner*—Alan Cariaso
*Assistant Examiner*—Ismael Negron
(74) *Attorney, Agent, or Firm*—Paul W. O'Malley; Susan L. Firestone

(57) ABSTRACT

An imitation candle is made from a translucent material having light transmissive properties similar to paraffin. The imitation candle is shaped to appear reduced by burning. An LED, or similar high intensity light source, is set in a cavity within the imitation candle. The LED preferably produces amber light to better resemble the color of candle light. The imitation candle diffuses the light emitted from the LED to create a warm, natural looking glow. Light emission levels from the LED are varied in a pseudo-random manner to simulate the flicker of candle light.

9 Claims, 4 Drawing Sheets

IMITATION CANDLE

BACKGROUND TO THE INVENTION

1. Field of the Invention

The present invention relates to low level luminaries and more particularly to an imitation candle used primarily for ornamentation and establishing ambience.

2. Description of the Problem

Many people find candle light pleasant. The flickering of light and movement of shadows across a floor or on a nearby wall can be almost hypnotically soothing. As a result, candles have remained popular for generations since the invention of more practical electrical lighting, especially for decorative and mood setting purposes. This has remained so notwithstanding the hazard posed by open flames and the consequent danger of household fires. Few people consider it safe to leave a lit candle unattended.

Consequently, numerous manufacturers have attempted to meet a demand for a candle like luminary using electrical illumination. There are many imitation candles available that use incandescent lamps or LED's as a light source. While these address people's concern with the open flame, most try to implement the appearance of a realistic flame using a specially shaped bulb or lens that is exposed to view. Typically, the bulb or lens sits on top of a thin cylindrical sleeve, which is shaped and colored to resemble a candle. The results are typically disappointing, especially when these devices are not illuminated. The visible, flame shaped artificial light source makes the imitation candle as a whole appear artificial. The result can look more like a caricature of a candle than a real candle. The color of incandescent light can leave something to be desired in many candles as well.

The use of frosted glass cylinders around incandescent light sources to diffuse light is known. Such products are pleasant and popular. However, the light produced by an incandescent source can be quite broad, and the top of the lamp must be open to allow heat to escape. Another product, sold by Eternalight, Inc. of Cortaro, Ariz., provides a plurality of LEDs arranged on a base inside a frosted glass cylinder. A computer is used to control current supplied the LEDs to change the color and intensity of the light emitted to give an artificial flame shape and motion and to vary the intensity of the artificial flame. A similar product is sold by Norex Enterprises, Inc. of Blauvelt, N.Y. In both cases the products place the artificial flame above a base. A frosted glass cylinder, open at the top, is then set on the base. The appearance is intended to be of a candle inside a glass lamp.

Candles of course do not all come in one shape or size. While a classical image of a candle is of a long, thin, tapering rod, which stands upright in a candle stick and which leaves its flame exposed as it burns down, many candles come as a relatively short to circumference block or cylinder which is self supporting. Such candles commonly leave the outer wall of the candle intact as the candlewick burns down. When this happens, the candle flame is no longer visible when viewed from the side. This results in a diffuse, flickering glow visible through the paraffin wall of the candle.

SUMMARY OF THE INVENTION

One object of the invention is to provide an electrical candle that provides realistic candle like light.

Another object of the invention is to provide an electrical candle that presents a realistic appearance when the candle is not lit.

Yet another object of the invention is to provide an imitation candle that uses a light-sensing device to turn the light source off during the day.

Still another object of the invention is to provide a flicker circuit that provides three or more distinct light levels that vary in a pseudo-random manner to provide a realistic variation in light output akin to a candle flame being disturbed by gentle air currents. A realistic flicker provides one more subconscious cue that the candle is real.

Yet another object of the invention is to provide a luminary that gives a very realistic representation of a broad, self supporting candle that has burned down to the point where the flame is not visible.

These and other objects are achieved as is now described. The imitation candle of the present invention hides the light source within the body of the luminary which gives the body a glow in much the same way that a real wax candle glows when illuminated by a depressed flame. There is no shaped imitation flame to betray the fact that the candle is not real. The light source is preferably a light emitting diode enclosed within the translucent material forming the body of the luminary. The translucent material surrounds the light emitting diode on the sides and top at least to an extent necessary to make direct viewing of the light emitting diode inconvenient. The light emitting diode is positioned near the top of the body so that the top is brighter than the lower parts of the candlestick, which again simulates the appearance of a real candle. Placing the light emitting diode near the top also creates a hot spot of light that can be seen in the translucent material when viewed from above. Recessing the top within the side walls presents the appearance of a candle that has already been burning for some length of time. The body of the imitation candle can be made from real wax to further enhance the imitation candle's realism. Alternatively, frosted glass or plastic materials may be used.

The invention provides an imitation candle having a body made from a translucent material having optically transmissive properties similar to candle paraffin. In a preferred embodiment the body of the imitation candle has a relatively large base or circumference relative to its height and is self supporting. The candle body is shaped to simulate a candle which has partially burned down, for example by forming a depression into an upper surface of a cylindrical candle body. A light emitting body, or similar small, high intensity light source, is set in a cavity enclosed within the translucent material. An emission color, such as amber, is selected for the LED to produce a light similar in color to candle light. The translucent material of the candle body diffuses the light emitted from the LED to create a warm, natural looking glow. When viewed from the side, the result is a very close approximation to a real candle when the wick has burned down to the point that the flame is not directly visible. The LED is preferably placed near the top of the translucent material but centered horizontally. The thinner material directly above the LED causes less diffusion of the light and produces a high intensity area of light that simulates the appearance of a candle flame when the candle is viewed from above.

The LED is preferably a super bright LED. Power consumption is low enough at low illumination levels that reasonable lifetimes can be achieved using batteries as a power source. Alternately, a wall-cube style power supply could be used to supply power and eliminate the need periodically to replace batteries. Alternately, rechargeable batteries can be used in conjunction with a solar cell or other recharging means. A simple circuit using multiple oscillators running at nearly the same frequency creates a realistic, pseudo-random flicker for light emitted by the LED. A simple light sensing device can be used to turn the LED off during daylight hours and extend battery life in battery operated versions of the candle.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
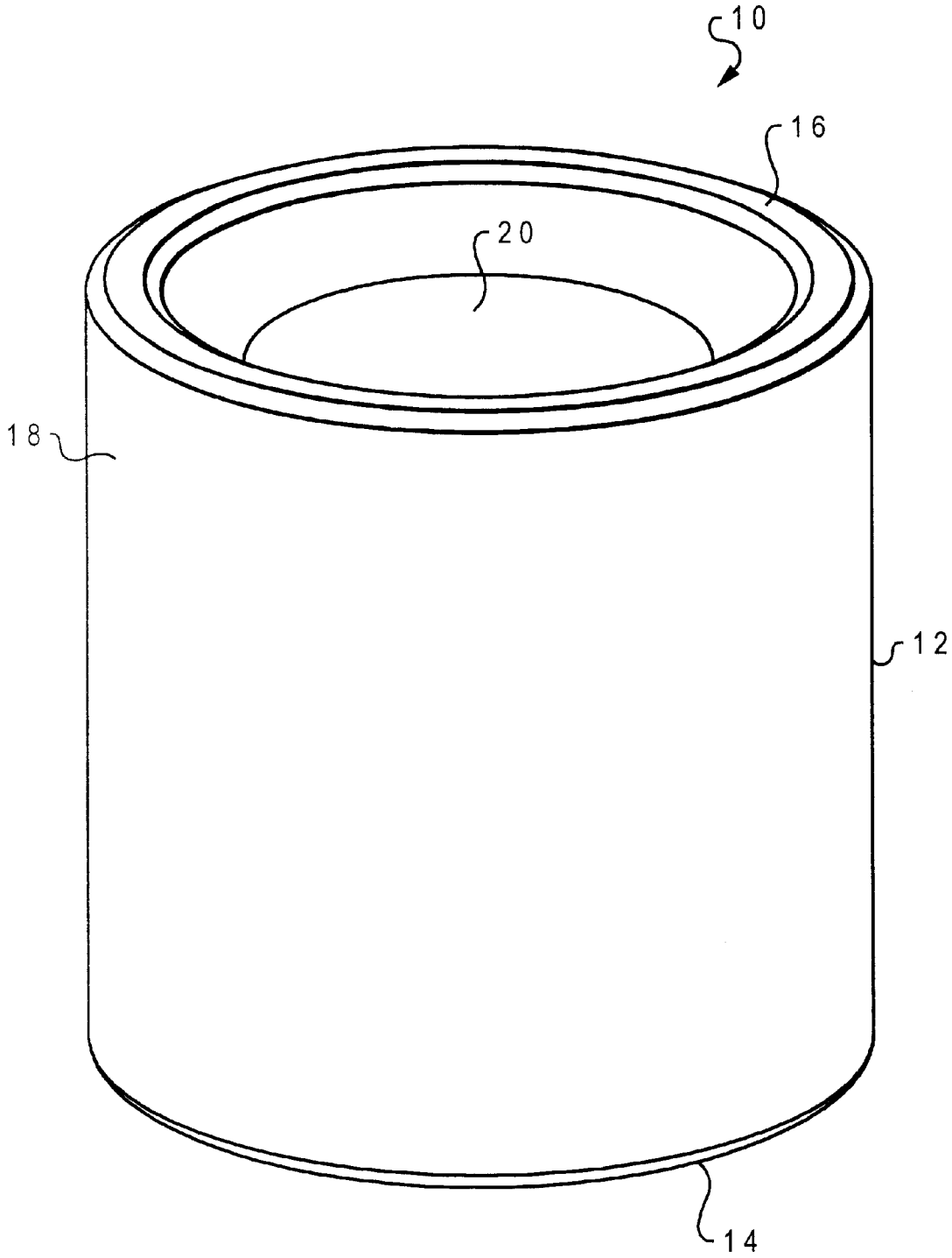
FIG. 1 is a perspective view of a preferred embodiment of the imitation candle of the invention.

Referring now to the drawings and in particular to FIG. 1 a preferred embodiment of the invention will be described. An imitation candle 10 includes a body 12 with a horizontal lower surface 14 on which it rests, an upper surface 16 and a cylindrical vertical side wall 18 between the lower and upper surfaces. Imitation candle 10 is preferably sized to resemble a self supporting candle having a relatively large circumference compared to its height. Slender, tapering bodies resembling classical candles, and other shapes, are possible and such configurations are within the scope of the invention, but embodiments using such shapes may not provide as esthetically a pleasing appearance in use due to the expectation that a flame be visible. While imitation candle 10 is illustrated as being cylindrical, other horizontal cross sectional shapes are possible, such as rectangular, as well as irregular shapes. Upper surface 16 includes an indented or depressed central region 20, which is preferably shaped to resemble a top portion of candle which has been reduced by melting to feed a flame supported from a central wick.

Figure 2:
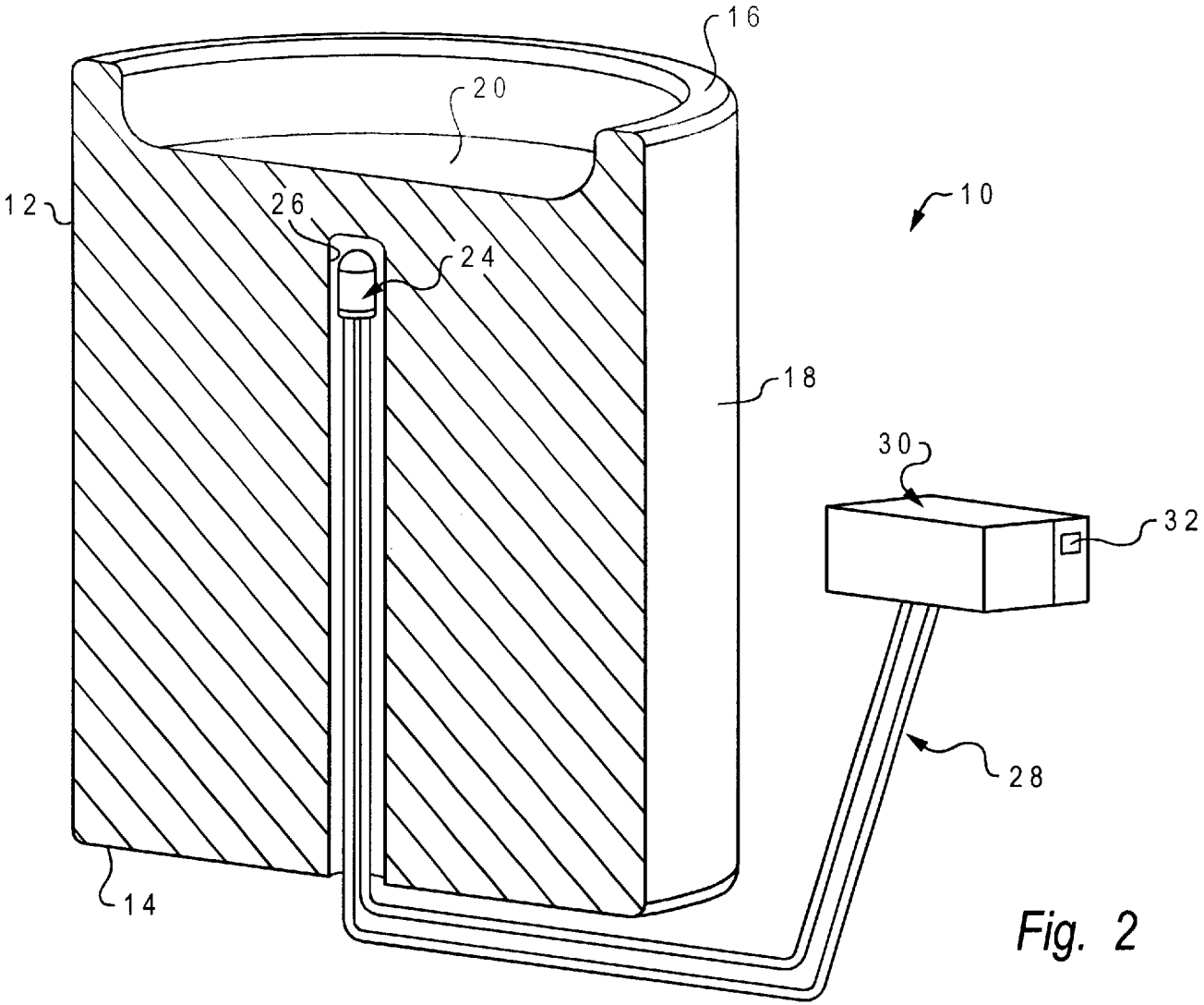
FIG. 2 is a partial cutaway view of an embodiment of the invention.

FIG. 2 shows a preferred embodiment of the invention in a cutaway view. A light source body 24 preferably emits light from a small area, which is preferably achieved by incorporating a super bright light emitting diode (LED). Light source body 24 is placed near the surface forming depressed central region 20 in a cavity 26 which extends from the lower horizontal surface 14 of body 12 to a point just below the upper surface 16. The material forming body 12 is preferably relatively thick and translucent and is shaped to resemble a candle that has been burning long enough to have burned away the inner portion of the wax (here depressed central region 20). The material can be wax, frosted glass, or plastic and is chosen to diffuse the light from the light source body 24 so that, when viewed from the side, the light is evenly scattered and provides a fairly evenly distributed glow. Pigments added to relatively clear plastics or glass with frosted surfaces should also produce satisfactory results, although wax is preferred.

The light intensity on cylindrical vertical sidewall 18 of the candle body 12 will be roughly proportional to the square of the distance between the light source body 24 and the surface. The thickness of material directly above the light source body 24 can be selected to generate a 'hot spot' of fairly intense light that is similar in size to the diameter of a real candle's flame. This hot spot imitates the candle flame that would normally be visible if a real candle is viewed from the top. Generally though, light source body 24 is positioned so as not to be conveniently directly viewable from outside of body 12. In other words, optically diffusing material is preferably interposed between a casual viewer and the light source body 24 from most if not all directions.

Light source body 24 is connected to a remote power source 30 by leads 28. Remote power source 30 may be taken to be a conventional step down power supply which may be plugged into a household wall socket. Alternatively, a source of power may be provided by an internal battery. A switch 32, which may be manually activated, timer based, light sensitive, or even accept remote control commands, may be incorporated into the power supply. The remote power source 30 would typically be hidden in a base designed to look like a typical candle stand or it could be disguised as, or hidden in, another decorative element. The housing for remote power source 30 preferably includes a flicker circuit (described below) to cause the LED in the light source body 24 to vary in brightness in a pseudo-random manner to simulate the flickering of a real candle flame. Yet another option is to provide a solar cell that charges one or more rechargeable batteries.

Figure 3:
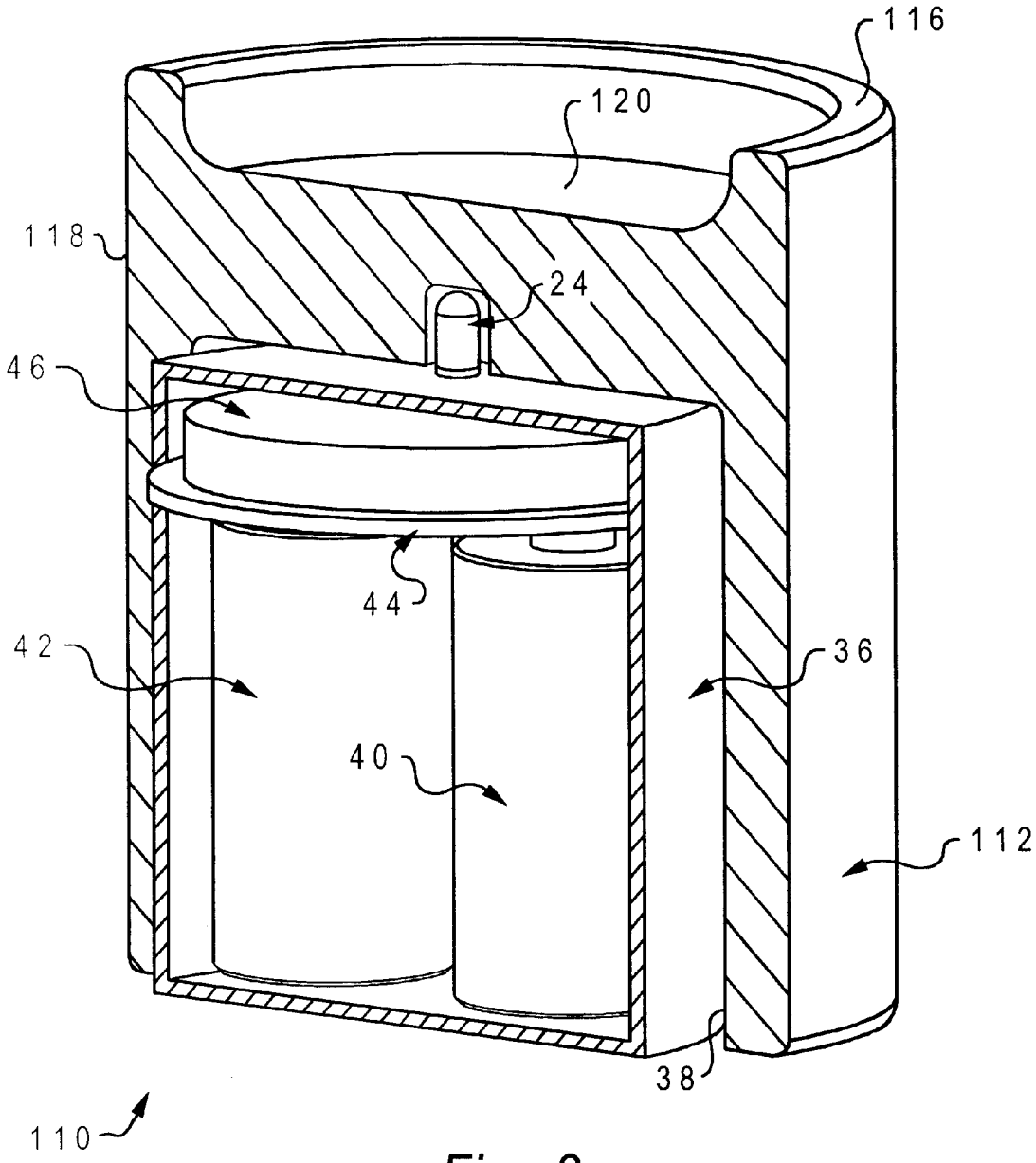
FIG. 3 is a partial cutaway view of a preferred embodiment of the invention.

FIG. 3 shows an alternative embodiment of the invention in which an imitation candle 110 incorporates a replaceable battery inside candle body 112. Light source body 24 incorporates a super bright LED as described above. A battery housing 36 is enclosed in an enlarged lower cavity 38 and holds two batteries 40 and 42 used as a power source. A printed circuit board 44 and light source energization circuit 46 are positioned in the housing 36. Embodiments of the invention using a single cell with a step up power supply can be used to save space in small candles. Additional cells or larger batteries can be used in large candles. The exterior configuration of body 112 of imitation candle 110 is generally similar to imitation candle 10, with a depressed central region 120 set in an upper surface 116, and a cylindrical vertical side wall 118.

Figure 4:
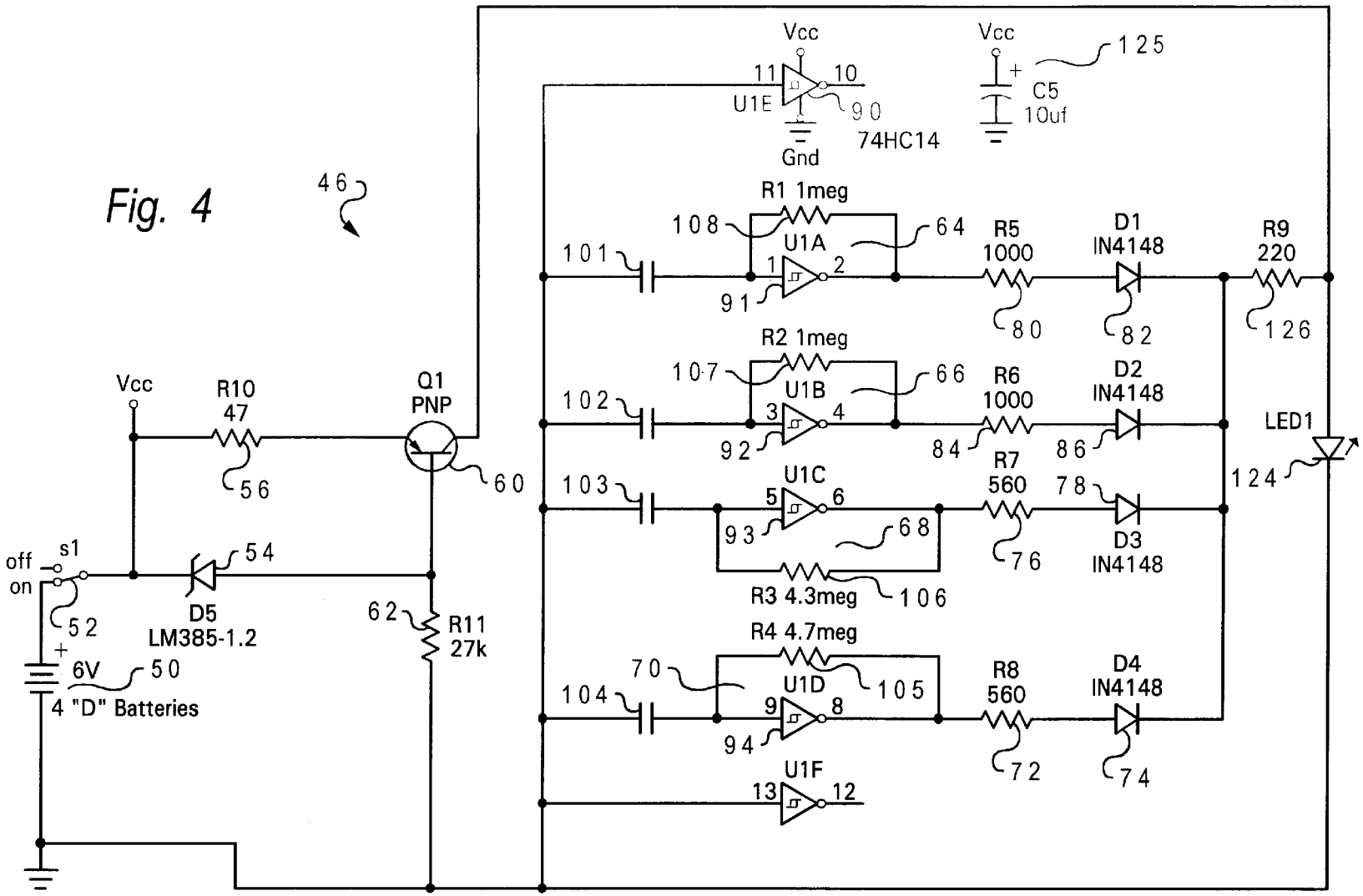
FIG. 4 is a circuit schematic for a luminary of the preferred embodiment.

FIG. 4 illustrates representative energization electronics 46 for driving an LED 124. A power source 50 is provided by four size D batteries. Different power sources can be used depending upon desired battery life or the desired brightness to be obtained from the LED. As mentioned above, alternatives include combinations of solar cells and rechargeable batteries or an outside line source of power. LED 124 is preferably provided in a Global Opto G-L202YTT-T amber light emitting diode package. Energization electronics may be switched on and off using a switch 52 which is attached at one pole to the positive terminal of battery 50. Switch 52 may be a photosensitive device, such a photosensitive transistor. Battery 50 also supplies $V_{CC}$ within energization electronics 46.

LEDs have a constant voltage drop when conducting current and the intensity of light emission from an LED is controlled by varying the current sourced to the LED. Accordingly, the LED energization circuit 46 sources a varying amount of current to LED 124. The first major element of energization circuit 46 is a base current source provided by zener diode 54, resistors 56 and 62, and a PNP transistor 60, which sources current to the load, here a light emitting diode 124. The voltage source provided by battery 50 is connected to the transistor 60 emitter by resistor 56 and to base of the transistor by reverse oriented zener diode 54. The transistor is assured of being constantly biased on by the voltage drop set by the reverse breakdown voltage of zener diode 54 as long as battery voltage remains the minimum required for zener breakdown operation. Thus transistor 60 sources current to the load through which the current returns to ground. As a result LED 124 always produces a minimum level of light output when the device is on.

Variation in light output is effected by variably increasing the current supplied to LED 124. A hex inverter, such as a SN74HC14N hex inverter, available from Texas Instruments of Dallas, Tex., is used to implement several parallel oscillators or clocks. All of the oscillators are identically constructed though external component values may be altered. In the preferred embodiment 4 of 6 available inverters (91–94) are used with resistors (105–108) providing feedback from the outputs of the inverters to the inputs. Capacitors 101–104 are connected from the inputs of inverters 91–94 to set the operating frequency of the oscillators. The connection of $V_{CC}$ to the inverters is represented for inverter 90 (U1E) only but is identical for each of inverters 91–94.

Oscillators 68 and 70 are designed to be low frequency oscillators running at approximately 2 Hz. Oscillators 68 and 70, formed using inverters 94 and 93, can use similar timing components to run at approximately a 10% difference in frequency. The 10% difference in frequency prevents oscillators 68 and 70 from synchronizing with each other or drifting past one another too slowly. Low frequency oscillators 68 and 70 provide current to the LED 124 through series connected resistors and forward biased diodes 76 and 78, and 72 and 74, respectively, to a summing junction. As a result, current flow through LED 124 is increased from the minimum set by the current source formed by PNP transistor 60 pseudo-randomly. When either of oscillators 68 or 70 is high, it supplies extra current to LED 124 and the LED becomes slightly brighter. When both of oscillators 68 and 70 are high, a third, higher level of current is supplied to the LED 124. The three current levels (both high, only one high, or both low) provide three brightness levels that can be selected by the choice of values for resistors 76 and 72 and the current from the current source. As long as the two oscillators are not synchronized, the three brightness levels will vary in a pseudo-random manner as the oscillators drift. Loose component tolerances are acceptable as contributing to the degree of randomness in current sourced to LED 124.

In some applications oscillators 68 and 70 may be set to have as great as a 2:1 variation in frequency. The rate at which the oscillators drift past one another is consequential to the appearance of the luminary.

In the preferred embodiment oscillator 66, formed using inverter 92, operates at about 8 Hz. and provides two more current levels. Three parallel current sources allow for a total of six brightness levels. Again the output from the inverter is fed through a series connected resistor 84 and forward biased diode 86 to a summing junction and then by resistor 126 to LED 124. The value chosen for resistor 84 is higher than for resistors 78 and 74 with the result that oscillator 66 makes a smaller current contribution to LED 124 than oscillators 68 and 70. This contributes still more to the impression of randomness in the light output of LED 124 by providing that changes in light output occur in differing sized steps. Oscillator 64, formed using inverter 91, is also set to run at about 8 Hz. The resistance of resistor 80 is comparable to that of resistor 84 so that oscillator 64 contributes a current comparable to the current supplied by oscillator 66. The current from inverter 91 is routed to LED 124 by resistor 80 and diode 82 to the summing junction and than by resistor 126. A capacitor 125 may be connected between $V_{CC}$ and ground to short circuit noise to ground preventing circuit noise from causing the oscillators to synchronize with one another.

As shown, two of the gates of the hex inverter are not used, but these gates could be used to create two more oscillators with outputs driving additional candles using multiple LEDs or supplying additional current levels to a single LED.

The invention provides an imitation candle that provides realistic candle like light while retaining a candle-like appearance when unlit. The light produced by the invention has a multitude of light levels that vary in a pseudo-random manner to provide variation in light output akin to a candle flame being disturbed by gentle air currents. The imitation candle of the invention can be readily used with decorative light fixtures that would typically use a candle, while sparing the user from the need of periodically cleaning the fixture of wax. The imitation candle can also serve as a stand alone luminary or it can be readily used in a variety of fixtures, such as outdoor landscape lights, patio lights, solar powered lights, night lights, etc.

While the invention is shown in only one of its forms, it is not thus limited but is susceptible to various changes and modifications without departing from the spirit and scope of the invention.

What is claimed is:

1. An ornamental illumination apparatus comprising:

a light diffusing body having permanent exterior surfaces including an upper surface with a depressed center section which appears reduced by melting;

a cavity within the light diffusing body; and a small high intensity light source disposed within the cavity to illuminate from below the bottom of the depressed center section more brightly than the other surfaces of the light diffusing body.

2. An ornamental illumination apparatus as claimed in claim 1, wherein the light diffusing body further comprises a lower surface and the light diffusing body is self supporting on the lower surface.

3. An ornamental illumination apparatus as claimed in claim 2, wherein the light diffusing body is made of candle wax.

4. An ornamental illumination apparatus as claimed in claim 2, wherein the small high intensity light source is a super bright light emitting diode having a predominant emission color of amber.

5. An ornamental illumination apparatus as claimed in claim 4, further comprising:

an energization circuit connected to the light emitting diode having a plurality of oscillators contributing varying portions of an energization current to the light emitting diode;

a power source;

the plurality of oscillators connectable to the power source, each oscillator being tuned to oscillate at a different frequency; and a summing junction combining the outputs of the plurality of oscillators to produce a pseudo-random variation in the energization current.

6. An ornamental illumination apparatus as claimed in claim 5, further comprising a second cavity and wherein the power source is a replaceable battery positionable in the second cavity.

7. An ornamental illumination apparatus as claimed in claim 5, wherein the power source is a wall socket compatible power supply.

8. An imitation candle comprising:

an optically translucent body shaped and sized to resemble a candle of sufficient diameter to support a depressed flame while leaving its outer walls intact;

a light source disposed within the optically translucent body having a light emission point at an anticipated location for the depressed flame where it cannot be conveniently directly viewed from outside the optically translucent body;

a power supply; and a flicker energization signal generator connected between the power supply and the light point source for delivering a varying energization signal to the light source.

9. An imitation candle as claimed in claim 8, further comprising:

the light source being a super bright light emitting diode;

the flicker energization signal generator having a plurality oscillators tuned to run at nearly the same frequency and to drift with respect to one another to produce component signals for a pseudo-random flicker energization signal; and a summer combining the components of the pseudo-random flicker energization signal and connected to apply the pseudo-random flicker energization signal to the super bright light emitting diode.

* * * * *